United States Patent [19]

Adams et al.

[11] 4,189,013

[45] Feb. 19, 1980

[54] ROOF DRILL BIT

[75] Inventors: Wayne F. Adams, Nortonville; Mark S. Greenfield, Henderson; Harry L. Seibert, Madisonville, all of Ky.

[73] Assignee: GTE Sylvania Incorporated, Stamford, Conn.

[21] Appl. No.: 907,095

[22] Filed: May 18, 1978

[51] Int. Cl.[2] ..... E21B 17/00

[52] U.S. Cl. ..... 175/320; 175/410

[58] Field of Search ..... 175/327, 409, 410, 320

[56] References Cited

U.S. PATENT DOCUMENTS

| | | | |
|---|---|---|---|
| 3,022,840 | 2/1962 | Hohos et al. | 175/327 X |
| 3,187,825 | 6/1965 | Bower, Jr. | 175/327 |
| 3,519,091 | 7/1970 | Leibee et al. | 175/320 |
| 3,807,515 | 4/1974 | Evans | 175/410 |
| 4,099,585 | 7/1978 | Emmerich | 175/410 X |

*Primary Examiner*—Ernest R. Purser
*Assistant Examiner*—Nick A. Nichols, Jr.
*Attorney, Agent, or Firm*—Donald R. Castle

[57] ABSTRACT

A roof drill assembly comprising a roof drill having a drill bit of a cylindrical configuration when used with a specifically designed drive rod and a means for retaining the drill bit within the drive rod enables a better dust removal during drilling and an increased load carrying ability of the shank. The drill bit body has two opposing symetrical lands including a web of uniform width extending across the diameter of the cylinder. The configuration forms a specific point angle, a chisel edge angle and a rake angle. The web contains a refractory metal carbide as a cutting surface and a shank extends from the body to engage a drive rod. The drive rod contains a tubular portion having an outer portion diameter compatible with the drill bit and an inner diameter to provide dust removal. A transition portion contains two channels that communicate from the opposing walls of the transition portion to the inner opening in the tubular drive portion that extends from the tubular portion. The transition portion extends to a drill bit receiving portion which has flat sides and is compatible to receive the insertion of the shank of the drill bit and retain it within the drive rod. A tubular drive portion extends from the transition portion that engages a driving means.

9 Claims, 11 Drawing Figures

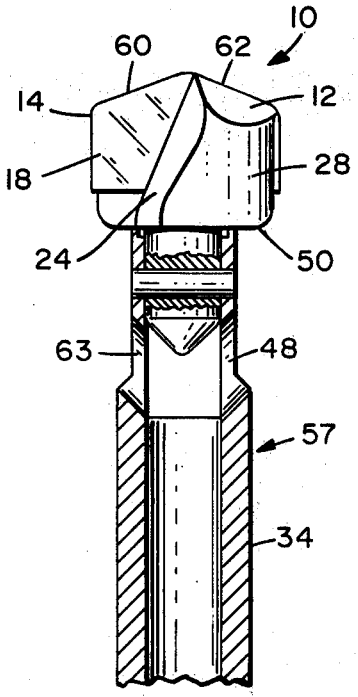
Fig. 3
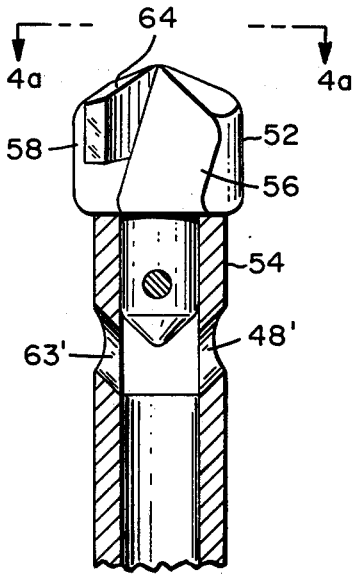
Fig. 4
PRIOR ART
Fig. 5
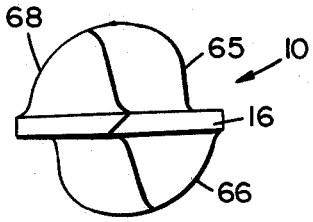
Fig. 6
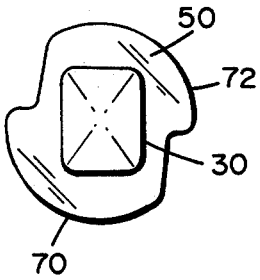
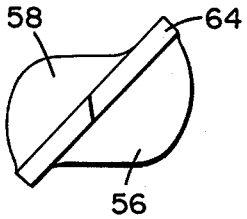
Fig. 4a
PRIOR ART

ROOF DRILL BIT

BACKGROUND OF THE INVENTION

1. Field of the Invention

This invention relates to roof drills used in drilling holes in the roof of a coal mine shaft for installation of roof bolts. More particularly it relates to a drill assembly that enables: (1) better removal of the dust created during drilling and (2) the ability to transmit increased drilling force to the bit through a strengthened shank thereby enabling a faster drilling speed.

2. Prior Art

Prior art "through the steel" drill assemblies do not have the rake of the drill portion designed such that the dust is created during drilling and directed downwardly from the drill bit is centered over the channels that communicate from the outside of the drill rod to the inner opening in the tubular drive rod. Vacuum is applied to the inner opening to remove the dust, however, since the dust was not centered over the channels removal was often hindered thus reducing penetration rates. It is believed, therefore, that a new drill assembly that enables the dust directed from the drill bit to be centered over the channels that communicate from the outside of the drive rod to the inner opening to which vacuum is applied enabling essentially all of the dust to be removed unhampered via the inner opening by the vacuum, would be an advancement in the art. This design also allows for a more massive shank to be used thus allowing higher cutting forces to be transmitted to the bit.

OBJECTS AND SUMMARY OF THE INVENTION

It is an object of this invention to provide a new drilling assembly that enables faster drilling and improved dust removal.

It is still another object of this invention to provide a new drill bit having a unique design when used in conjunction with the drive rod enables more adequate dust removal and larger drilling forces to be transmitted.

These and other objects are achieved in one aspect of this invention by providing a roof drill bit comprising a generally cylindrical body portion comprising two symmetrical land portions including a web of substantially uniform width extending across the diameter of said cylinder and containing a refractory metal carbide cutting portion, the web forming a first vertical surface of each land portion substantially in the form of a vertical plane, two cutting edges at the upper extremity of the first vertical surface of each land, each edge having a length approximately equal to the radius of said cylinder one edge on one side of the web and at the end of the web, the other edge on the opposite side of the web and at the opposite end of the web. The web forms a point angle of about 135° to about 145°, a chisel angle of from about 145° to 155° and having a chisel edge connecting the two inner ends of the cutting edges. The land portions have a sloping upper surface that forms a lip relief angle of about 8° to about 12°, a planar lower surface intersecting the first vertical surface at about 90°, a second vertical surface that defines a sloping plane intersecting the planar lower surface at an angle of from about 65° to about 70° and intersects the web portion of the opposing land along its first vertical surface and a curved third vertical surface that joins the first and second vertical surfaces and has a radius of curvature approximately equal to the radius of the cylinder, the third surface intersects the lower planar surface at an angle of about 90°, the third surface at its upper edge forms a segment of a circle measuring about 73° to about 77° and the lower edges a segment of from about 110° to about 130°, the second vertical surface of one land portion and the first vertical surface of the opposing land portion forms a sloping flute having a rake angle of from about 20° to about 25° and a shank extends from the planar surface that is adapted for removably engaging a driving means for the drill bit. The drive rod for the drill bit comprises of a tubular portion having one end adapted for receiving a drive means and an opposing end having an inside diameter substantially equal to the width of the shank of the drill bit and an outside diameter that is smaller than the diameter of the body of the drill bit, thereby forming an inner opening in the drive portion. A transition portion extends from the before-mentioned opposing end of the drive portion and has two channels that communicate from opposing walls to the inner opening in the drive portion. The end of the transition portion adjacent to the drive portion is substantially the same shape as the tubular drive portion and the opposing end has two flat sides on the same side as the channels. The channels are substantially circular in cross-section and have a diameter of from about 75% to about 100% of the diameter of the inner opening. The width of the flat side is greater than the diameter of the channel. The drive rod has a drill bit receiving portion that extends from a noncylindrical end of the transition portion and has a female opening adapted for receiving the shank of the drill bit. The female opening has a compatible geometric shape to enable the insertion of the shank without rotation of the shank of the drill bit within the female opening of the drive rod. The overall assembly when connected to a means for rotating the bit and drive rod enables the dust to be removed from the hole being drilled in an improved manner. The more massive drive rod enables higher drilling speeds to be achieved.

BRIEF DESCRIPTION OF THE DRAWINGS

FIG. 3 is a side view of the drill bit and the drive rod of this invention.

FIG. 4 is a side view of the drill bit and the drive rod of the prior art.

FIG. 5 is a top view of the drill bit of this invention.

FIG. 6 is a bottom view of the drill bit of this invention.

FIG. 4*a* is a top view of a prior art drill bit.

DESCRIPTION OF THE PREFERRED EMBODIMENTS

For a better understanding of the present invention, together with other and further objects, advantages and capabilities thereof, reference is made to the following disclosure and appended claims in connection with the above described drawings.

Figure 1:
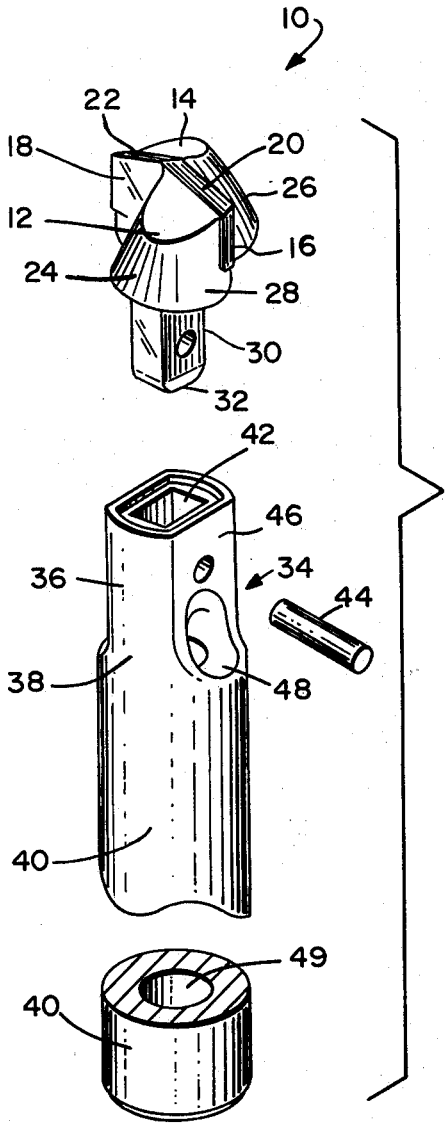
FIG. 1 is an exploded perspective view of the drilling assembly of this invention.

With particular reference to FIG. 1 there is shown an exploded view of the complete drill assembly of this invention. The roof drill bit 10 is comprised of a generally cylindrical body portion containing two opposing land portions, 12 and 14 that include a web portion 16. The web 16 forms a first vertical surface 18 of land portion 14. A similar first vertical surface of the other land 12 is also formed but is not shown in FIG. 1. The upper edge of the first vertical surface forms cutting edges 20 and 22. The land portions 12 and 14 also contain sloping second vertical surfaces 26 and 24. The curved third vertical 28 of land portion 12 is shown in FIG. 1 while the corresponding surface of land portion 14 can not be seen in FIG. 1. A shank 30 extends from the body portion 10 and optionally may contain a tip 32 while the particular embodiment shown is a rectangular prism, other designs can be used. The design of the tip 32 can vary depending upon the type of drilling.

A drive rod 34, particularly adapted for the roof drill bit 10, is shown in FIG. 1 and comprises a drill bit receiving portion 36, a transition portion 38 and a tubular drive portion 40. The drill bit receiving portion 36 has a female opening 42 for receiving the shank 30 of the drill bit 10. In the particular embodiment shown, the female opening 42 is designed in a manner to enable insertion and withdrawal of a shank allowing retention without rotation inside the female opening 42. A means 44 retains the drill bit 10 in the drive rod 34. The transition portion 38 extends from the drill bit receiving portion 36 to the tubular drive portion 40. The drill bit receiving portion 36 has two flat sides (one flat side 46 is shown in FIG. 1) aligned with two channels in the transition portion 38 (one channel 48 is shown in FIG. 1). The tubular drive portion 40 has an outside diameter less than the diameter of the drill bit 10 and the inside diameter is sufficiently large to provide an inner opening 49 in the drive rod 34 for dust removal.

Figure 2:
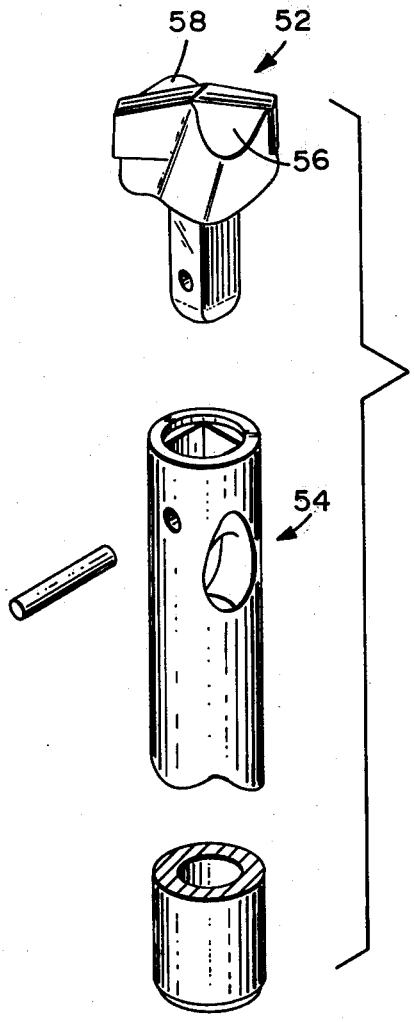
Fig. 2 PRIOR ART
FIG. 2 is an exploded perspective view of the prior art drilling assembly of this invention.

With particular reference to FIG. 2, an exploded view of a prior art drill assembly is shown that comprises the prior art drill bit 52 and prior art drive rod 54. The land portions 56 and 58 have a different design and the drive rod 54 is substantially a uniform tube.

With particular reference to FIG. 3, a side view of drill bit 10 is shown along with a cross-sectional view of the drive rod 34 assembled to form a drilling assembly of this invention. The upper edges 60 and 62 of the web of the drill bit form a point angle (as defined by American Standard Twist Drill Nomenclature) of from about 135° to about 145°. The lands also form a lip relief angle (as defined by the American Standard Twist Drill Nomenclature) of from about 8° to about 12°. Also in FIG. 3 the first vertical surface 18 of one land portion is shown along with the sloping second vertical surface 24 and the curved vertical surface 28 of the opposing land portion 12. The edge of the lower planar surface 50 of the drill bit 10 can be seen. FIG. 3 shows the intersection of the second vertical surface 24 with the lower planar surface 50 somewhat rounded from an angle of from about 65° to 75°. It is preferred to forge the drill bits rather than by machining. If the drill bit were machined the angle would be 65° to 75°. Additionally, the second vertical surface 24 of one land portion 12 and the first verticle surface 18 of the other land portion 14 form a sloping flute with a rake angle of from about 20° to 25°. Rake angle is defined by American Standard Twist Drill Nomenclature. While drill bit 10 can be used with conventional drive rods, it is preferred to use it in conjunction with the drive rod 34 designed for particular utilization with drill bit 10. As is shown in FIG. 3 the two channels 48 and 63 in the drive rod 34 communicate from the external wall to the inner opening.

With particular reference to FIG. 4 a side view of a prior art drill bit 52 in conjunction with a cross sectional view of a prior art drive rod 54 is shown. The drill bit 52 has a design such that the upper portion and lower portions of the lands are approximately the same. This is more graphically illustrated in a top view shown in FIG. 4*a*. When assembled the channels 63 and 48 that communicate from the external surfaces of the drive rod 54 are not in vertical alignment with the lower edges of the web 64 thus the dust created during drilling is misdirected.

With particular reference to FIG. 5 a top view of the drill bit 10 is shown. The chisel edge 65 is shown and a chisel edge angle, as defined by American Standard Twist Drill Nomenclature, of from about 145° to 155° is formed at the web 16. As is apparent the upper edges of the curved third vertical surfaces 66 and 68 are segments of a circle measuring from about 73° to about 77°.

With particular reference to FIG. 6 a bottom view of drill bit 10 is shown. Shank 30 extends from the lower planar surface 50. The lower outer edges 70 and 72 are the form of segments of a circle measuring about 110° to about 130°.

The refractory metal carbide cutting portion such as tungsten carbide can be inserted into the web in any manner desired. Generally a groove or slot is machined into the web and the carbide is brazed into place.

Figure 7:
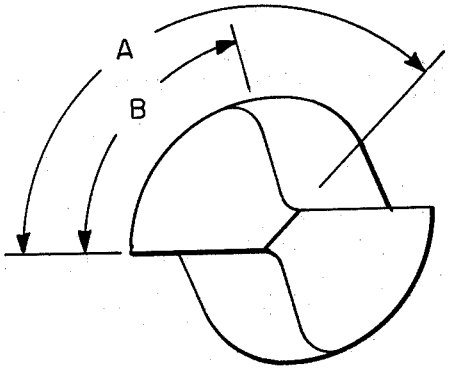
FIGS. 7 through 10 are supplemental views of the drill bit of this invention showing certain angles and other angular portions of drill bit.

With particular reference to FIG. 7, angle A is the chisel edge angle which can vary from about 145° to 155° and B is the segment of the circle that one of the third surfaces forms at its upper edge. An identical opposing segment is formed by the other third surface. These segments can vary from about 73° to about 77°.

Figure 8:
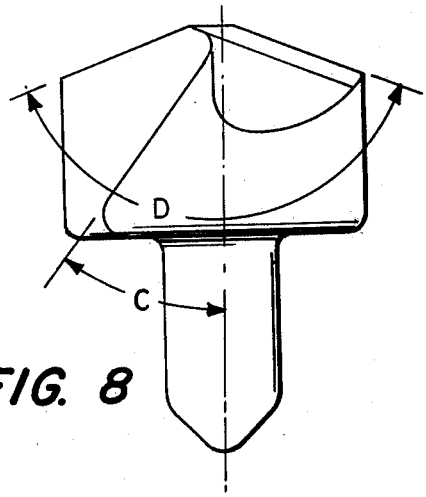

With particular Ref to FIG. 8, angle C is the rake angle which can vary from about 20° to about 25°. Angle D is the point angle which can vary from about 135° to about 145°.

Figure 9:
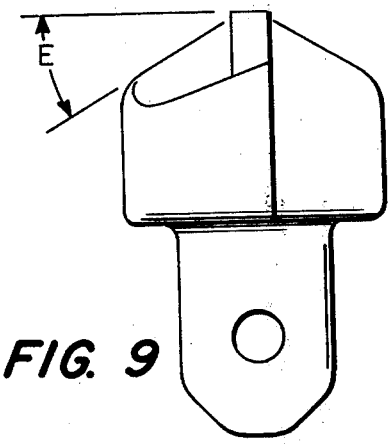

With particular reference to FIG. 9, angle E is the lip relief angle which can vary from about 8° to about 12°.

Figure 10:
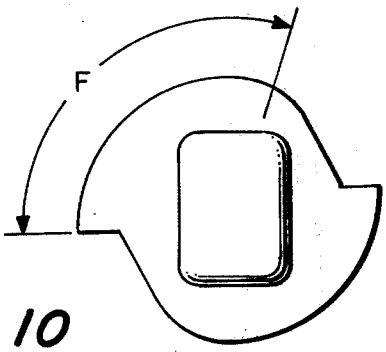

With particular reference to FIG. 10, F illustrates the segment of the circle that one of the third surfaces forms at its lower edge. An identical opposing segment is formed by the other third surface. These segments vary from about 110° to about 130°.

What is claimed is:

1. A roof drill bit compising:

(a) a generally cylindrical body portion comprising two symmetrical land portions including a web of substantially uniform width extending across the diameter of said cylinder and containing a refractory metal carbide cutting portion, said web forming a first vertical surface of each land portion substantially in the form of a vertical plane, two cutting edges at the upper extremity of said first vertical surface of each land, each edge having a length approximately equal to the radius of said cylinder, one edge on one side of said web and at the end of said web, the other edge on the opposite side of said web and at the opposite end of said web, said web forming a point angle of about 135° to about 145°, a chisel edge angle of from about 145° to about 155° and a chisel edge connecting the inner end of said cutting edges, said land portions having a sloping upper surface forming a lip relief angle of about 8° to about 12°, a planar lower surface intersecting said first vertical surface at about 90°, a second vertical surface defining a sloping plane intersecting the planar lower surface at an angle of from about 65° to about 70° and intersecting the web portion of the opposing land along its first vertical surface and a curved third vertical surface joining said first and second vertical surfaces and having a radius of curvature approximately equal to the radius of the cylinder, said third surfaces intersects said lower planar surface at an angle of about 90°, said third surface at its upper edge forming a segment of a circle measuring about 73° to about 77° and at its lower edge forming a segment of a circle measuring about 110° to about 130°, the second vertical surface of one land portion and the first vertical surface of the opposing land portion forming a sloping flute with a rake angle of from about 20° to about 25° and (b) a shank extending from the planar surface adapted for removably engaging a driving means for said drill bit.

2. A drive rod for a drill bit of claim 1 comprising (a) a tubular drive portion having one end adapted for receiving a drive means and an opposing end and having an inside diameter sufficient to provide dust removal and an outside diameter less than the diameter of the body of the drill bit, thereby forming an inner opening in said drive portion, (b) a transition portion extending from said drive portion, having two channels communicating from opposing walls of said transition portion to the inner opening in said tubular drive portion, the end of said transition portion adjacent to said drive portion being the same shape as said tubular portion, the opposing end having two flat sides on the same side as said channels, said channels being substantially circular in cross-section and having a diameter of from 75% to about 100% of the diameter of the inner opening in said tubular drive portion, the width of said flat sides being greater than the diameter of said channels, (c) a drill bit receiving portion, extending from the non-cylindrical end of said transition portion, having a female opening adapted for receiving the shank of said drill bit, said female opening being a compatible geometric shape to enable insertion of said shank into said female opening and sufficiently small to prevent the rotation of said shank within said female opening, said female opening communicating with said inner opening in said tubular drive portion, and (d) means for retaining said drill bit in said drive rod.

3. A roof drill bit according to claim 1 wherein said shank is in the form of a rectangular prism.

4. A roof drill bit according to claim 3 wherein a tip extends from the end of the shank opposed to the end adjoining the body portion.

5. A roof drill bit according to claim 4 wherein said refractory metal carbide cutting portion is a cemented tungsten carbide cutting portion brazed to the body portion.

6. A roof drill assembly comprising:

(I) a drill bit comprising:

(a) a generally cylindrical body portion comprising two symmetrical land portions including a web of substantially uniform width extending across the diameter of said cylinder and containing a refractory metal carbide cutting portion, said web forming a first vertical surface of each land portion substantially in the form of a vertical plane, two cutting edges at the upper extremity of said first vertical surface of each land, each edge having a length approximately equal to the radius of said cylinder, one edge on one side of said web and at the end of said web, the other edges on the opposite side of said web and at the opposite end of said web, said web forming a point angle of from about 135° to about 145° C., a chisel angle of from about 145° to about 155° and a chisel edge connecting the inner end of said cutting edges, said land portions having a sloping upper surface forming a lip relief angle of about 8° to about 12°, a planar lower surface intersecting said first vertical surface at about 90°, a second vertical surface defining a sloping plane intersecting the planar lower surface at an angle of from about 65° to about 70° and intersecting the web portion of the opposing land along its first vertical surface and a curved third vertical surface joining said first and second vertical surfaces and having a radius of curvature approximately equal to the radius of the cylinder, said third surfaces intersect said lower planar surface at an angle of about 90° said third surface at its upper edge forming a segment of a circle measuring about 73° to about 77° and at its lower edge forming a segment of a circle measuring about 110° to about 130°, the second vertical surface of one land portion and the first vertical surface of the opposing land portion forming a sloping flute with a rake angle of from about 20° to about 25° and (b) a shank extending from the planar surface adapted for removably enganging a driving for said drill bit (II) a drive rod comprising:

(1) tubular drive portion having one end adapted for receiving a drive means and an opposing end having an inside diameter sufficient to provide dust removal and an outside diameter less than the diameter of the body of drill bit, thereby forming an inner opening in said portion, (2) a transition portion extending from said drive portion having two channels communicating from opposing walls of said transition portion to the inner opening in said tubular drive portion, the end of said transitition portion adjacent to said drive portion being the same shape as said tubular portion, the opposing end having two flat sides on the same side as said channels said channels being substantially circular in cross-section and having a diameter of from 75% to about 100% of the diameter of the inner opening in said tubular drive portion, the width of said flat sides being greater than the diameter of said channels, (3) a drill bit receiving portion extending from the non-cylindrical end of said transition portion having a female opening adapted for receiving the shank of said drill bit, said female opening being a compatible geometric shape to enable insertion of said shank into said female opening and sufficiently small to prevent the rotation of said shank within said female opening, said female opening communicating with inner opening in said tubular drive portion, and (III) means for retaining said drill bit within said drive rod so that the rakes of said flute are in alignment with said channels in said drive rod.

7. A roof drill assembly according to claim 6 wherein said shank is in the form of a rectangular prism.

8. A roof drill assembly according to claim 7 wherein a tip extends from the end of the shank opposed to the end adjoining the body portion.

9. A roof drill assembly according to claim 8 wherein said refractory metal carbide cutting portion is a cemented carbide cutting portion brazed to the body portion.

* * * * *